US007029150B2

(12) United States Patent
Finch

(10) Patent No.: US 7,029,150 B2
(45) Date of Patent: Apr. 18, 2006

(54) CATADIOPTRIC LIGHT DISTRIBUTION SYSTEM

(75) Inventor: Timothy S. Finch, Fishers, IN (US)

(73) Assignee: Guide Corporation, Pendleton, IN (US)

( * ) Notice: Subject to any disclaimer, the term of this patent is extended or adjusted under 35 U.S.C. 154(b) by 24 days.

(21) Appl. No.: 10/763,785

(22) Filed: Jan. 23, 2004

(65) Prior Publication Data

US 2005/0162854 A1 Jul. 28, 2005

(51) Int. Cl.
*F21V 7/00* (2006.01)

(52) U.S. Cl. ..... 362/298; 362/299; 362/300; 362/301

(58) Field of Classification Search ..... 362/298–302, 362/305, 328–329, 335, 346–347, 349, 520
See application file for complete search history.

(56) References Cited

U.S. PATENT DOCUMENTS 1,883,360 A * 10/1932 Fortney ..... 362/510
3,779,629 A 12/1973 Green
4,899,261 A 2/1990 Blusseau et al.
5,122,939 A 6/1992 Kazdan et al.
5,309,339 A * 5/1994 Webb ..... 362/259
5,309,340 A 5/1994 Shigeta et al.
5,582,480 A 12/1996 Zwick et al.
6,050,705 A 4/2000 Kusserow et al.
6,065,846 A 5/2000 Kato et al.
6,332,701 B1 12/2001 Yamada et al.
6,558,032 B1 5/2003 Kondo et al.
6,672,741 B1 * 1/2004 Young ..... 362/311

* cited by examiner

*Primary Examiner*—Sandra O'Shea
*Assistant Examiner*—Robert May
(74) *Attorney, Agent, or Firm*—Ice Miller LLP

(57) ABSTRACT

A Catadioptric Light Distribution System that collects and collimates the hemispherical pattern of light emitted by a Lambertian light emitting diode (LED) into a collimated beam directed essentially parallel to the optical axis of the LED. The system comprises a circular condensing lens having a center axis that is aligned with the optical axis of the LED parabolic reflector having circular opening formed therethrough which is centered on the center axis of the parabolic reflector and a double bounce mirror. The light reflected and culminated by the parabolic reflector is directed onto the circular annular double bounce mirror so that this light is collimated in an annular beam which passes around the edge of the condensing lens.

12 Claims, 3 Drawing Sheets

CATADIOPTRIC LIGHT DISTRIBUTION SYSTEM

BACKGROUND OF INVENTION

1. Field of the Invention

The present invention relates to a catadioptric light distribution system for collimating a hemispherical pattern of light distributed by a lambertian light emitting diode into a collimated beam of light directed essentially along the optical axis of the LED. More particularly, the present system relates to a catadioptric light distribution system that can be used to culminate a beam light from an LED for automotive lighting purposes.

2. Detailed Description of the Prior Art

Light emitting diodes, commonly called LEDs, are well known in the art. LEDs are light producing devices that illuminate solely as a result of electrons moving in a semi-conductor material. Consequently, LEDs are advantageous as compared to filament type bulbs because an LED has no filament to burn out. Consequently, LEDs generally have a life as long as a standard transistor, and as a result have been utilized in a variety of different devices where longevity of the light source is important. Originally, LEDs were quite small and limited in their capacity to produce light. However, advances in the technology have increased the amount of light (luminous flux (Lm) or radiometric power (mW)) that an LED is capable of producing. Consequently, practical applications for LEDs have been expanded to include automotive lighting purposes.

Lambertian LEDs are also well known in the art. LEDs typically have a hemispherical top that is centered on an optical axis through the center of the LED, however other top surfaces can be used. The light emitted by the Lambertian LED is in a hemispherical pattern from 0° to approximately 90° measured from the optical axis and 360° around the optical axis. In addition, LEDs are typically mounted on a heat sink that absorbs the heat generated by the LED when it is producing light.

Unfortunately, conventional optical systems cannot culminate all of the light emitted by a Lambertian LED because of the wide spread of light emitted by and physical constraints of a Lambertian LED. For example, U.S. Pat. No. 6,558,032-Kondo et al. illustrates one prior art attempt to effectively distribute light from a Lambertian LED. However, the various light distribution systems illustrated in Kondo et al. are not very effective in collimating the light from an LED into an effective beam.

Accordingly, it is a primary object to the present invention to provide a catadioptric light distribution system that effectively collimates substantially all the light emitted by a Lambertian LED into a beam of light essentially parallel to the optical axis of the LED.

SUMMARY OF THE INVENTION

A catadioptric light distribution system in accordance with the present invention comprises an LED having a central optical axis and which is capable of emitting light in a hemispherical pattern distributed 360° around the optical axis and from 0° to approximately 90° measured from the optical axis. A circular condensing lens having a center axis is aligned so that the center axis of the circular condensing lens coincides with the optical axis of the LED. The condensing lens is positioned apart from the LED and the condensing lens is configured to receive and collimate a central cone of light emitted from the LED that is centered around the optical axis. A parabolic reflector is also provided. The parabolic reflector has a center axis through the center of the parabolic reflector which is aligned with the optical axis of the LED. The parabolic reflector also has a circular opening through the parabolic reflector that is centered on the optical axis. The circular opening is dimensioned to allow the cone of light from the LED to pass through the parabolic reflector and impinge upon the condensing lens. The parabolic reflector is positioned around the LED in a position to receive that remaining portion of the light emitted by the LED that does not pass through the opening. The parabolic reflector is configured to redirect the light received from the LED into an annular beam that is focused in a direction parallel to the optical axis but in a direction away from the condensing lens. A circular annular double bounce mirror is positioned and configured to receive the annular beam of light from the parabolic reflector and reverse the direction of that light a 180° so that it forms an annular culminated beam around the outside edge of the condensing lens. The light culminated by the condensing lens and the light culminated by the circular annular double bounce mirror form a single culminated beam parallel to the optical axis.

Thus, the present invention collects substantially all of the light emitted by a Lambertian LED and focuses that light into a culminated beam in a direction along the optical axis of the Lambertian LED.

DESCRIPTION OF THE PREFERRED EMBODIMENT

Figure 1:
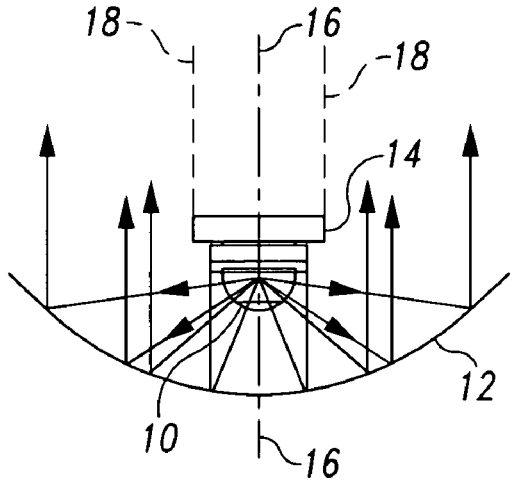
Fig. 1 (Prior Art)
FIG. 1 illustrates a prior art system using a Lambertian LED and a parabolic reflector.

FIG. 1 discloses a prior art system which uses a Lambertian LED 10 and a parabolic reflector 12. Because of the heat generated by a LED, the LED includes a heat sink 14 on the back of the LED. The parabolic reflector 12 is configured to culminate light generated at the focal point of the paraboloid and culminate that light outwardly. The LED is placed at the focal point of the parabolic reflector and it is facing the parabolic reflector 12 and aligned so that the optical axis of the LED and the center axis of the parabola 16 are aligned. Because the Lambertian LED emits light 360° around the optical axis and from 0 to about 90° as measured from the optical axis, a hemispherical light distribution pattern is produced. Unfortunately, because of the heat sink 14 mounted on the base of the Lambertian LED 10, light reflected by the center of the parabolic reflector 12 is essentially blocked by the heat sink 14 so that a dark shadow column as depicted by the dotted lines 18, is produced in the center of reflector system. Thus, a significant portion of the light emitted by the Lambertian LED 10 is blocked by the heat sink 14 in this prior art system.

Figure 2:
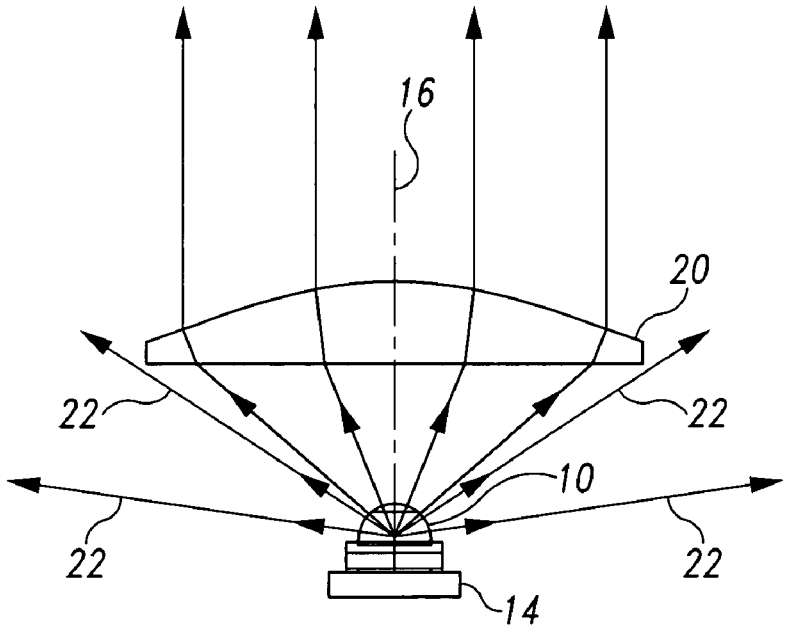
Fig. 2 (Prior Art)
FIG. 2 illustrates a prior art system using a Lambertian LED and a condensing lens.

FIG. 2 represents another prior art system for culminating the light produced by a Lambertian LED 10. A circular condensing lens 20 is positioned apart from the LED 10 with the center axis of the condensing lens 20 aligned with the optical axis 16 of the Lambertian LED. Thus, the condensing lens 20 receives a cone of light from the LED 10 with the conical angle of the cone of light being a function of the diameter of the condensing lens 20. Because a condensing lens is capable of effectively culminating light impinging upon its surface an angle no greater than approximately 50°, that portion of the hemisphere of light produced by the LED as shown by arrows 22 in FIG. 2 cannot be effectively collimated. This reduces the amount of light from the LED that can be focused into a collimated beam using this prior art system.

Figure 3:
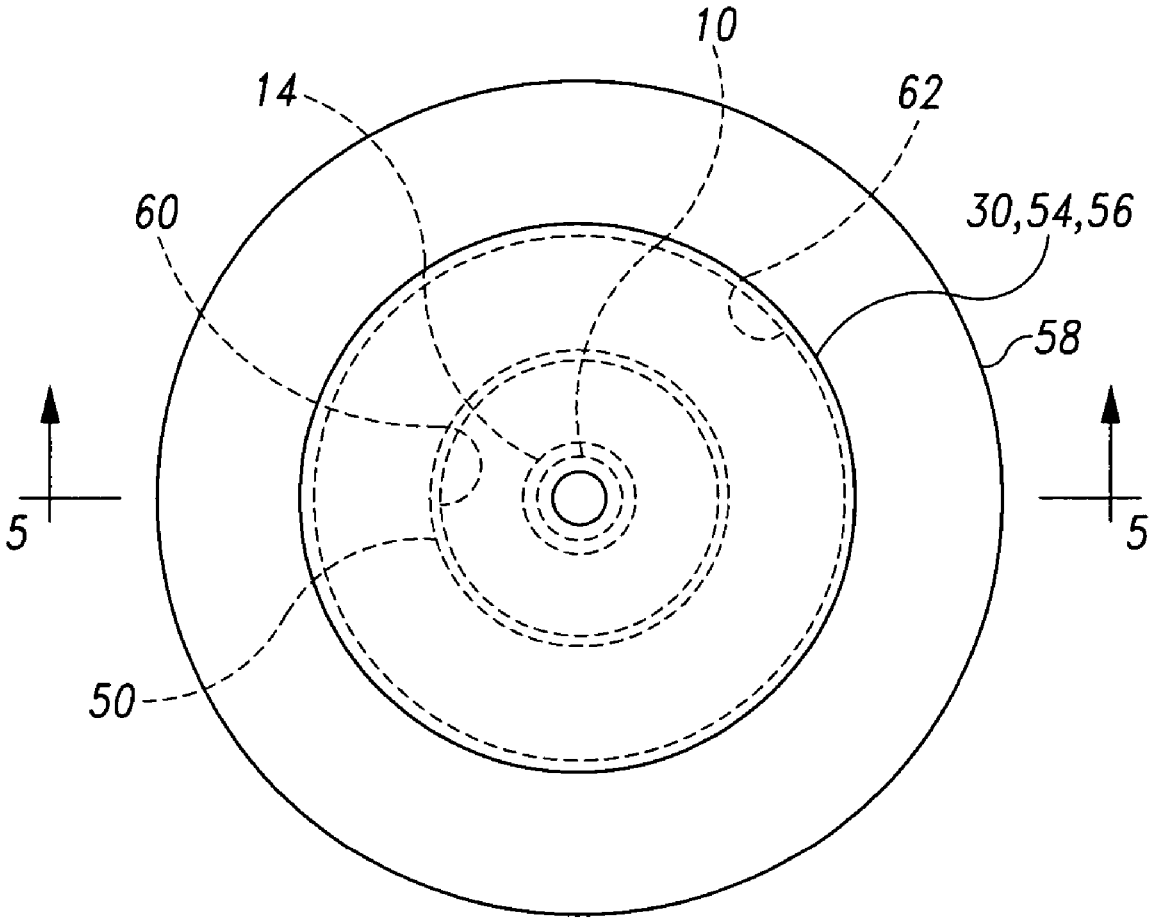
FIG. 3 is a top view of a preferred embodiment of the present invention.
Figure 4:
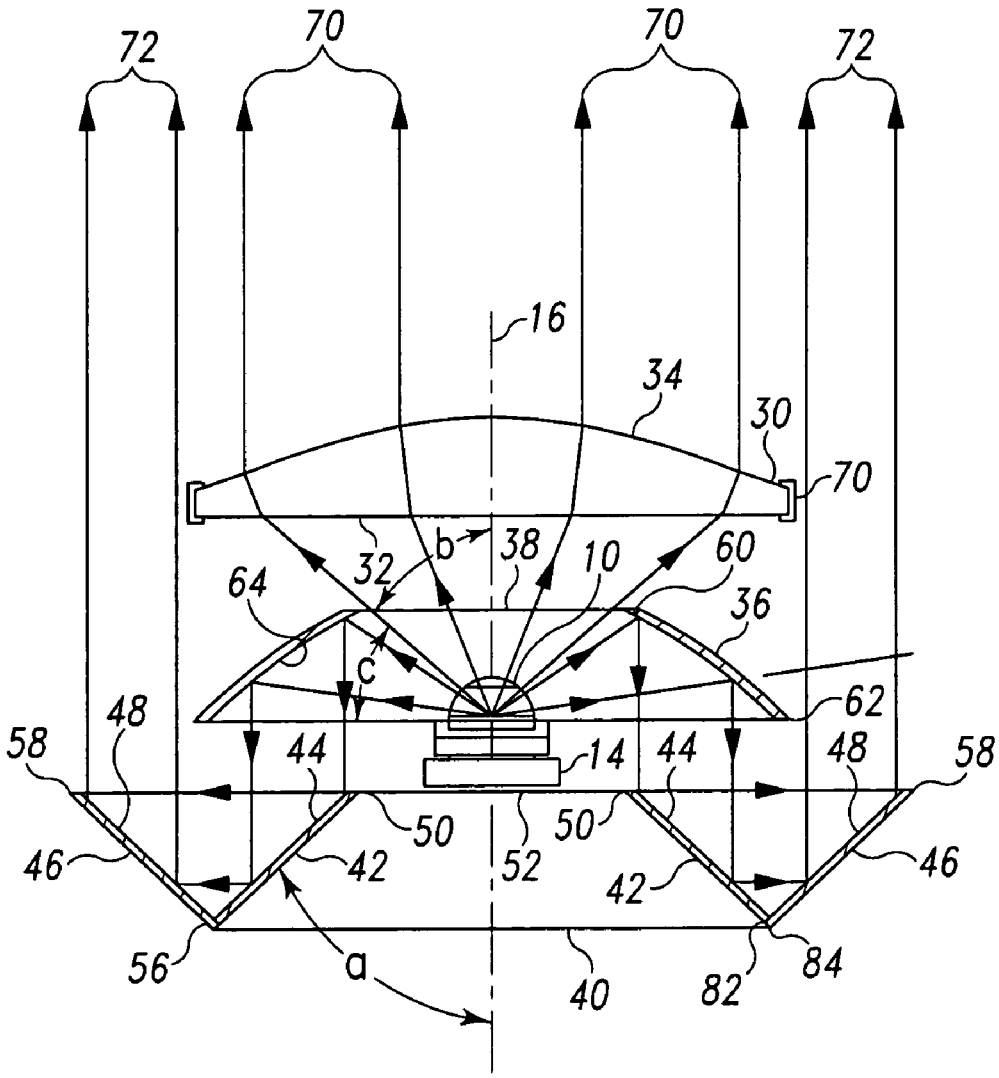
FIG. 4 is a cross sectional side view of the preferred embodiment of the present invention taken along lines 5—5 in FIG. 3 showing the light distribution produced by the present invention.

With reference to FIGS. 3 and 4 a preferred embodiment of the present invention is illustrated. An LED 10 is shown mounted on a heat sink 14. The LED 10 has an optical axis 16 which extends upwardly as shown in FIG. 3. A circular condensing lens 30 is positioned apart from the LED with the center axis of the circular condensing lens aligned with the optical axis 16 of the LED and the LED at the focal point of the condensing lens 30. The condensing lens 30 typically has a first flat face 32 and a second curved face 34. A parabolic reflector 36 is positioned so that its center axis aligns with the optical axis 16 of the LED 10 and its focal point aligns with the LED. The parabolic reflector 36 has a circular opening 38 formed there through which opening is centered on the center axis of the parabolic reflector 36.

Positioned behind the LED 10 and also centered on the optical axis of the LED is a circular annular double bounce mirror 40. With reference to FIG. 4, it can be seen that the circular annular double bounce mirror 40 comprises a first circular annular mirror 42 which in cross section has a flat reflecting surface 44 which is angled at an angle "a" that is 45° as measured from the optical axis 16. The circular annular double bounce mirror 40 also comprises a second circular annular mirror 46 which in cross section has a flat mirror surface 48 that is aligned at an angle of 90° with respect to the flat mirror surface 44. The circular annular mirror 42 has a first interior circular edge 50 with a first exterior edge 82. First interior circular edge 50 defines a circular opening 52 aligned around the optical axis 16. The circular annular mirror 42 also has a second exterior circular edge 58 and a second interior edge 84 joined to the first exterior edge 82. Second exterior circular edge 58 extends entirely around the perimeter of the circular annular double bounce mirror 40. Mirror 42 has two reflecting surfaces 44 and 48 oriented 90° with respect to one another and which are joined along an edge 56.

With reference to FIG. 4, parabolic reflector 36 has an interior edge 60 which defines the condensing lens aperture 38 centered on the optical axis 16 and an exterior edge 62 which defines the circular open face of the parabolic reflector 36. Parabolic reflector 36 has an interior curved reflecting surface 64 which is formed to receive a toroid of light from the LED 10 and reflect that light in a culminated annular beam towards the flat mirror surface 44 of first circular annular mirror 42.

The aperture 38 in parabolic reflector 36 allows a cone of light having a conical angle of "b" to pass through the aperture 38 and impinge upon the flat surface 32 of condensing lens 30. The combination of the flat surface 32 and the curve surface 34 of lens 30 are configured to culminate the cone of light passing through aperture 38 into a beam of light parallel to the optical axis 16 as shown by the arrows 70 in FIG. 4. The conical angle "b" may typically be between 30 and 50 degrees as measured from the optical axis. Angle "b" is a function of the diameter of condensing lens 20 and the diameter of opening 38 in parabolic reflector 36. These diameters can be varied to allow as broad a cone of light that can be effectively collimated by lens 20 to be passed through aperture 38.

Similarly, a toroid of light from LED 10 strikes the curve surface 64 of parabolic reflector 36. That toroid of light can have a toroidial angle "c" the difference of between about 30° to about 90° (i.e. 60°) as measured from the optical axis to between the difference about 50° to 90° (i.e. 40°) as measured from the optical axis depending on the conical angle "b" of the cone of light passing through opening 38. That toroid of light is reflected downwardly in a collimated annular beam of light onto flat mirror surface 44 which, in turn, directs the light 90 degrees across to the flat surface 48 of second annular circular mirror 46 which, in turns, reflects the light 90 degrees in a direction parallel to the optical axis 16 as illustrated by the arrows 72 in FIG. 4. Thus, the circular annular double bounce mirror redirects the light by 180°.

Because the circular edge of condensing lens 30 essentially coincides with the circular junction 56 of surfaces 44 and 48 of annular mirror 42 because the diameters are substantially the same, the light reflected by the circular annular double bounce mirror forms an annular beam which passes by the edge of circular condensing lens 30 and blends with the light collimated by condensing lens 20. As can be seen by FIG. 4, substantially all of the hemispherical pattern of light distributed by the Lambertian LED 10 is effectively culminated into a beam of light parallel to the optical axis 16 as is depicted by the arrows 70 and 72.

While elements of the preferred embodiment illustrated in FIGS. 3–4 are shown floating without visible support, it should be understood by one of ordinary skill in the art that appropriate structural supports such as a lens holder may be supplied to support the various elements of the system. It should also be expressly understood that various modifications, alterations or changes may be made to the preferred embodiment illustrated above without departing from the spirit and scope of the present invention as defined in the appended claims.

I claim:

1. A catadioptric light distribution system comprising:

a light emitting diode (LED) having an optical axis and capable of emitting light in an essentially hemispherical pattern distributed 360 degrees around said optical axis and in multiple directions from zero degrees along the optical axis to approximate 90 degrees measured from the optical axis;

a circular condensing lens having a center axis aligned with said optical axis and positioned apart from said LED, said condensing lens configured to receive and collimate a central cone of the light emitted from said LED, said cone of light being essentially centered around said optical axis;

a parabolic reflector having a center axis aligned with said optical axis of said LED, said parabolic reflector having a circular opening formed therethrough centered on said center axis, said opening dimensioned to allow said cone of light from said LED to pass through said parabolic reflector and impinge on said condensing lens, said parabolic reflector positioned around said LED to receive tat portion of the light emitted by said LED that does not pass through said opening; said parabolic reflector configured to direct said light received from said LED in an annular beam in a direction parallel to the optical axis but in a direction away from said condensing lens;

a circular annular double bounce minor configured and positioned to receive the annular beam of light from said parabolic reflector and reverse the direction of that light 180 degrees and form in an annular collimated beam essentially parallel to said optical axis around said condensing lens;

whereby substantially all of the light emitted by said LED is collimated into a beam of light substantially parallel to said optical axis of said LED.

2. A catadioptric light distribution system as claimed in claim 1 wherein said LED is a Lambertian pattern LED.

3. A catadioptric light distribution system as claimed in claim 1 wherein said condensing lens is positioned and has a diameter sufficient to receive a cone of light from said LED having a conical angle of between about 30 and about 50 degrees measured from the optical axis.

4. A catadioptric light distribution system as claimed in claim 1 where in said parabolic reflector is dimensioned and configured to receive a toroid of light from said LED having a toroidal angle of the difference between about 30 to about 90 degrees to the difference between about 50 to about 90 degrees measured from said optical axis.

5. A catadioptric light distribution system as claimed in claim 1 where in said circular annular double bounce mirror comprises a first circular annular mirror having, in cross section, a flat face angled at essentially 45 degrees as measured from said optical axis, said first circular annular mirror having a first interior circular edge and a first exterior circular edge, and a second circular annular mirror having a second circular interior edge joined to said first exterior circular edge of said first circular annular mirror, and a second circular exterior edge, said second circular annular mirror having, in cross section, a flat face that is at an angle of essentially 90 degrees with respect to said first circular annular mirror.

6. A catadioptric light distribution system as claimed in claim 5 wherein said circular condensing lens has a diameter and said first circular exterior edge and said second circular interior edge have a diameter that is substantially equal to said diameter of said condensing lens.

7. A catadioptric light distribution system for an automobile comprising:

a Lambertian pattern light emitting diode (LED) having an optical axis and capable of emitting light in an essentially hemispherical pattern around said optical axis;

a circular condensing lens having a focal point and a center axis aligned with said optical axis and positioned with said LED at said focal point of said condensing lens, said condensing lens configured to receive and collimate a central cone of the light emitted from said LED, said cone of light being essentially centered around said optical axis;

a parabolic reflector having a focal paint and a center axis aligned with said optical axis of said LED, said parabolic reflector having a circular opening formed therethrough centered on said optical axis, said opening dimensioned to allow said cone of light from said LED to pass through said parabolic reflector and impinge on said condensing lens, said parabolic reflector configured and positioned around said LED to receive that portion of the light emitted by said LED that does not pass through said opening; said parabolic reflector configured to direct said light received from said LED in an annular beam in a direction parallel to the optical axis but in a direction away form said condensing lens;

a circular annular double bounce mirror configured and positioned to receive the annular beam of light from said parabolic reflector and reverse the direction of that beam of light 180 degrees and form in an annular collimated beam around said condensing lens essentially parallel to said optical axis;

whereby substantially all of the light emitted by said LED is collimated into a beam of light substantially parallel to said optical axis of said LED.

8. A catadioptric light distribution system as claimed in claim 7 wherein said condensing lens is positioned and has a diameter sufficient to receive a cone of light from said LED having a conical angle of between about 30 and 50 degrees as measured from the optical axis.

9. A catadioptric light distribution system as claimed in claim 7 where in said parabolic reflector is dimensioned and configured to receive a toroid of light from said LED having a toroidal angle of the difference between about 30 to about 90 degrees to the difference between about 50 to about 90 degrees as measured from said optical axis.

10. A catadioptric light distribution system as claimed in claim 7 where in said circular annular double bounce mirror comprises a first circular annular mirror having, in cross section, a flat face angled at essentially 45 degrees as measured from said optical axis, said first circular annular mirror having a first interior circular edge and a first exterior circular edge, and a second circular annular mirror having a second circular interior edge joined to said first exterior circular edge of said first circular annular mirror, and a second circular exterior edge, said second circular annular minor having, in cross section, a flat face that is at an angle of essentially 90 degrees with respect to said first circular annular mirror.

11. A catadioptric light distribution system as claimed in claim 10 wherein said circular condensing lens has a diameter and said first circular exterior edge and said second circular interior edge have a diameter that is substantially equal to said diameter of said condensing lens.

12. A catadioptric light distribution system as claimed in claim 11 wherein said parabolic reflector has an exterior diameter that is substantially the same as the diameter of said condensing lens.

* * * * *